US009876306B2

(12) United States Patent
Kaesser et al.

(10) Patent No.: US 9,876,306 B2
(45) Date of Patent: Jan. 23, 2018

(54) METHOD FOR PRODUCING A MODULAR ELECTRICAL CONNECTOR ASSEMBLY FOR A CONTROL UNIT IN A MOTOR VEHICLE

(71) Applicant: Robert Bosch GmbH, Stuttgart (DE)

(72) Inventors: Rainer Kaesser, Althuette (DE); Dieter Ludwig, Lugwigsburg (DE); Hubert Hickl, Weinstadt (DE); Guido Bernd Finnah, Weissach (DE)

(73) Assignee: ROBERT BOSCH GMBH, Stuttgart (DE)

( * ) Notice: Subject to any disclaimer, the term of this patent is extended or adjusted under 35 U.S.C. 154(b) by 244 days.

(21) Appl. No.: 14/775,223

(22) PCT Filed: Jan. 10, 2014

(86) PCT No.: PCT/EP2014/050351
§ 371 (c)(1),
(2) Date: Sep. 11, 2015

(87) PCT Pub. No.: WO2014/139692
PCT Pub. Date: Sep. 18, 2014

(65) Prior Publication Data

US 2016/0020546 A1 Jan. 21, 2016

(30) Foreign Application Priority Data

Mar. 11, 2013 (DE) ..... 10 2013 204 149

(51) Int. Cl.
*H01R 43/00* (2006.01)
*H01R 13/514* (2006.01)
(Continued)

(52) U.S. Cl.
CPC ..... *H01R 13/514* (2013.01); *H01R 13/504* (2013.01); *H01R 43/18* (2013.01); *H01R 2201/26* (2013.01); *Y10T 29/49117* (2015.01)

(58) Field of Classification Search
CPC ... H01R 24/60; H01R 43/18; Y10T 29/49204; Y10T 29/49117; Y10T 29/49826
(Continued)

(56) References Cited

U.S. PATENT DOCUMENTS 5,110,307 A 5/1992 Rapoza
5,298,683 A 3/1994 Taylor
(Continued)

FOREIGN PATENT DOCUMENTS

DE 102011006195 10/2012

OTHER PUBLICATIONS

International Search Report for PCT/EP2014/050351, dated Feb. 28, 2014.

*Primary Examiner* — Thiem Phan
(74) *Attorney, Agent, or Firm* — Norton Rose Fulbright US LLP; Gerard Messina

(57) ABSTRACT

A method for producing a modular electrical connector assembly for a vehicle control unit, the connector assembly having a module carrier and at least two connector modules disposed side-by-side on the carrier. Each connector module has a connector housing collar and a plurality of contact elements disposed in a contact area within the connector housing collar. First, one of the connector modules is placed in an opening in the module carrier and positioned precisely relative to the module carrier. The connector module is pressed with a hold-down device against the module carrier retained in a holding device. In this state, the connector module is laser-welded to the carrier in an attachment region with a laser beam. Laser welding permits a reliably stable
(Continued)

and fluid-tight, material-locking connection between the components, and an advantageous, space-saving placement of the attachment region laterally within the collar, with higher manufacturing precision and small manufacturing tolerances.

13 Claims, 3 Drawing Sheets

(51) Int. Cl.
*H01R 13/504* (2006.01)
*H01R 43/18* (2006.01)

(58) Field of Classification Search
USPC ..... 29/825, 829, 842, 874, 876
See application file for complete search history.

(56) References Cited

U.S. PATENT DOCUMENTS

| | | | | |
|---|---|---|---|---|
| 6,821,145 | B1 | 11/2004 | Pollock et al. | |
| 6,932,644 | B1 | 8/2005 | Taylor | |
| 7,234,950 | B1 * | 6/2007 | Wickett ..... | H01R 13/504<br>439/247 |
| 7,300,310 | B2 * | 11/2007 | Taylor ..... | H01B 17/305<br>439/586 |

* cited by examiner

METHOD FOR PRODUCING A MODULAR ELECTRICAL CONNECTOR ASSEMBLY FOR A CONTROL UNIT IN A MOTOR VEHICLE

FIELD OF THE INVENTION

The present invention relates to a method for producing a modular electrical connector assembly for a control unit in a motor vehicle.

BACKGROUND INFORMATION

Today's motor vehicles offer a multitude of safety, comfort and information functions. To that end, the motor vehicles usually have various actuators and sensors. A control unit in the motor vehicle is used, for example, to pick up and process signals from the sensors, as well as to output control signals to the actuators. With an increase of functions intended to be offered in a motor vehicle comes also an increase in the demands on the control unit that controls these functions. In particular, a number of electric lines needed, with whose aid data and signals may be exchanged between the control unit and sensors or actuators, increases as well. For example, today's control units already have up to 200 electrical data lines and signal lines. Often, several lines are combined to form one wiring harness so as, for example, to permit the exchange of data between the control unit and a further unit already providing a function.

In order, for instance, to be able to service or repair the control unit, the lines are generally not connected permanently to the control unit, but rather are releasably attached to the control unit via a plug connection. Provided on the control unit for that purpose is a plurality of contact elements, e.g., in the form of plug pins or sockets, which are wired up in the interior of the control unit to corresponding signal lines and data lines to, e.g., control components or data-processing components of the control unit. These contact elements are able to cooperate with complementary mating contact elements that are provided in a connector, e.g., at the end of a wiring harness. The connector is plugged releasably into suitable receptacles on the control unit to thus produce an electrically conductive connection between the lines of the wiring harness and the associated contact elements of the control unit.

It has been observed that for control units which provide a very great number of contact elements for, e.g., up to 200 or more electric lines, it may be difficult to position the contact elements on the control unit with sufficient exactitude. Therefore, it was proposed in DE 10 2011 006 195 A1, for example, to provide a control unit with a modular electrical connector assembly, in which a plurality of connector modules are disposed side-by-side in a module carrier. In this case, each of the connector modules may be produced separately and with high precision. To produce the connector modules, in particular, injection-molding technologies may be used which, although permitting sufficiently high precision in the case of small assemblies, for very large units for connectors having, e.g., 200 contact elements, are often encumbered with a warpage and inadequate positioning precision resulting from that. In putting the connector assembly together, the various connector modules may be placed with suitable precision in relation to the module carrier, and only then be joined mechanically to the module carrier.

SUMMARY

Specific embodiments of the method proposed here for producing a modular electrical connector assembly are able to make it possible, inter alia, both to produce a connector assembly provided with a plurality of connector modules using manufacturing technologies that are easy to use on a large industrial scale, and at the same time, to satisfy high demands, for instance, with respect to manufacturing precision, stability of the connector assembly and/or low costs.

According to one aspect of the present invention, a method is proposed for producing a modular electrical connector assembly for a control unit in a motor vehicle, in which the connector assembly has a module carrier and at least two connector modules. The two connector modules are disposed side-by-side, that is, within one common plane, on the module carrier. Each of the two connector modules has a connector housing collar that projects in a direction away from the module carrier and is formed in each case to receive one electrical connector. The two connector modules each have a plurality of contact elements, e.g., in the form of contact pins or sockets, which are situated in a contact area within the respective connector housing collar and are formed to cooperate with complementary mating contact elements of the respective electrical connector. The manufacturing method proposed is characterized by a combination of the following method steps: First of all, in each case one of the connector modules is disposed in an opening in the module carrier, and the connector module is positioned precisely relative to the module carrier. The connector module is subsequently pressed against the module carrier and then laser-welded to the module carrier in an attachment region.

In other words, ideas concerning the method proposed here for producing a modular connector assembly may be regarded, inter alia, as based on the concepts and findings described hereinafter.

It was recognized that in control units in which a multitude of contact elements must be provided, which in each case are supposed to be contacted by connectors to be plugged into the control unit, that increased precision in placing the contact elements may be achieved if the contact elements are not disposed in a single component, since when working with a single component which is produced using an injection molding process, for example, it may be difficult to produce large components with narrow manufacturing tolerances. Instead, the intention is to provide the contact elements on a plurality of separate smaller connector modules, which may then be attached to one common module carrier. The comparatively small connector modules may be produced with high precision using an injection molding process, for example. The module carrier may also be produced using an injection molding process. To ultimately produce the entire connector assembly from these two prefabricated types of components, the connector modules may be introduced into openings provided in the module carrier. In this context, the openings may preferably have a slightly larger cross-sectional area than that of the connector modules, so that each connector module may still be shifted slightly within the opening, and thus may be adjusted precisely to a position ultimately to be assumed.

However, in producing such a connector assembly, one must be able to ensure that it must satisfy essentially the same physical requirements with regard to accuracy, tightness and strength to be achieved as was the case, for example, with conventional connector assemblies provided as a small monolithic injection-molded part. The stringent accuracy requirements may be necessary so as to be able to ensure perfect contacting of a printed circuit board, for instance. Tightness requirements with respect to moisture may be high because the connector assembly is used in a control unit in the engine compartment of a motor vehicle. Strength requirements, e.g., to absorb axial insertion forces, as well as sufficient stability in response to vibratory stresses that, for example, may stem from the mass of a wiring-harness connector itself as well as a continuing cable loop, may likewise be set high. In addition, the modular electrical connector assembly should be as small as possible and require little space.

In order, among other things, to satisfy these requirements, it is proposed to join the connector modules to the module carrier by laser welding. Laser-welding processes have been recognized as advantageously implementable for industrial production. Particularly in producing connector assemblies, properties of laser-welding processes have been well-known as advantageous to the effect that individual connector modules may first of all be positioned precisely in relation to the module carrier, that in this position, may then be pressed against the module carrier, and that no further forces are exerted on the connector module or the module carrier during subsequent laser welding to the module carrier, so that the exact positioning set beforehand is not jeopardized during the laser-welding process. Moreover, it has been determined that if the laser-welding process and the pressing of the connector module against the module carrier are carried out in suitable fashion, there is hardly any risk that one of the two components to be joined by laser welding will become deformed. In addition, the laser-welding process produces no flakes or other dirt particles which may lead to damage of the control unit; for example, the damage may be of the electrical sort or may result in an inadequately firm or insufficiently impervious bonding of the plug connector. All in all, very high manufacturing precision accompanied by low manufacturing tolerances may be achieved using the manufacturing method proposed.

It may be advantageous when using the manufacturing method proposed, if the module carrier and the connector modules are made of different materials, and if a laser is used for the laser welding whose laser beam is absorbed considerably less in the material of one of the two components, that is, either in the module carrier or in one of the connector modules, than in the material of the other component. In this case, the laser beam may be directed in the attachment region through the more weakly absorbent component onto the more strongly absorbent component.

In other words, it is possible to take advantage of the fact that different materials, especially different plastic materials, exhibit different absorption properties with respect to injected laser radiation. The materials for the module carrier and the connector module may be selected accordingly, so that the laser light emitted for the laser welding does not need to strike directly on an area to be melted, that is, without having to pass through other firm material beforehand. Instead, one of the materials used for the module carrier or the connector module may be selected to be transparent for the laser radiation employed, so that the laser radiation may be directed through the corresponding component onto the area to be melted. In this manner, the possibilities as to how the laser radiation used for the laser welding is able to be beamed in may be made considerably more flexible.

According to one advantageous embodiment, the module carrier and/or the connector modules has/have a projecting segment in the attachment region. For example, the segment may be provided on the module carrier and project from it toward the connector module. Alternatively or additionally, the segment may be provided on the connector module and project toward the module carrier. In the course of laser welding the connector module to the module carrier, this segment may be used as attachment region which is melted during the welding, and after subsequent solidifying, then joins the two components to each other with material locking. Laterally next to the segment, a remaining free space may be provided between the module carrier and the respective connector module, material removed during the laser-welding process being able to flow into the free space.

According to one advantageous development, the attachment region is situated laterally between the connector housing collar and the contact area in which the contact elements are disposed. In other words, a connector module is secured to the module carrier in an attachment region which is located laterally within a contour formed by the connector housing collar, but laterally outside of the contact area in which the, for example, pin-shaped contact elements are to be located. For instance, for stability reasons, a free space is usually provided between the contact area and the connector housing collar in any case, and in this way may be used advantageously to secure the two components together. Therefore, no additional space needs to be provided outside of the connector housing collar in order to join the two components to each other. Accordingly, adjacent connector modules may be secured very close together on the module carrier, allowing the overall space needed for the connector assembly to be minimized.

For instance, a laser beam employed during the laser-welding process may be directed laterally within the connector housing collar onto the attachment region. In particular, if, for example, the material of the connector module is selected to be transparent for the laser beam, such a laser beam directed onto an inner area within the connector housing collar may penetrate through a bottom of the connector module by radiation and be absorbed at a boundary surface to the module carrier and melt material at this boundary surface. The laser-welding process proposed thus makes it possible to attach the connector module and the module carrier to each other in an attachment region that may lie within a bottom area of the connector housing collar, that is, within the bottom area to be provided in any case for receiving the connector. Space for the connector assembly may thereby be minimized.

In one advantageous refinement, the module carrier is retained in a holding device during the laser-welding process, and the connector module is pressed against the module carrier by a displaceable hold-down device. The structurally larger module carrier may therefore be kept stationary in the holding device during the entire manufacturing process, and each of the connector modules to be joined to this module carrier may be pressed onto the module carrier by a suitable displaceable hold-down device and then attached to it by laser welding. In so doing, one uniform hold-down device may be used for different connector modules. Alternatively, a special hold-down device having suitable geometry may be provided for each of the connector modules to be attached. The displacement of the hold-down device and the pressure force exerted by it against the module carrier may be precisely controlled.

In one advantageous embodiment, the contact elements may first be inserted into the connector module after the laser-welding process. Because the connector module is initially welded onto the module carrier without the contact elements, it is possible, for example, to avoid the situation where the contact elements partially block the laser beam used during the laser-welding process, or limit the possibilities as to how this laser beam may be guided. However, it is also quite possible to weld the connector module to the module carrier after the contact elements have already been inserted, provided it is ensured that the contact elements are formed and disposed in such a way that they do not negatively influence the laser-welding process.

It is pointed out that possible features and advantages of the invention herein are described in connection with various specific embodiments of a method for producing a connector assembly. One skilled in the art will recognize that the features may be combined or exchanged with each other in suitable manner to permit the attainment of further specific embodiments and possibly synergistic effects.

BRIEF DESCRIPTION OF THE DRAWINGS

Specific embodiments of the present invention are described below with reference to the accompanying drawing, neither the description nor the drawing being intended to be interpreted as limiting the invention.

The figures are only schematic and not true-to-scale. Identical reference numerals illustrate identical or identically acting features in the various figures.

DETAILED DESCRIPTION

Figure 1:
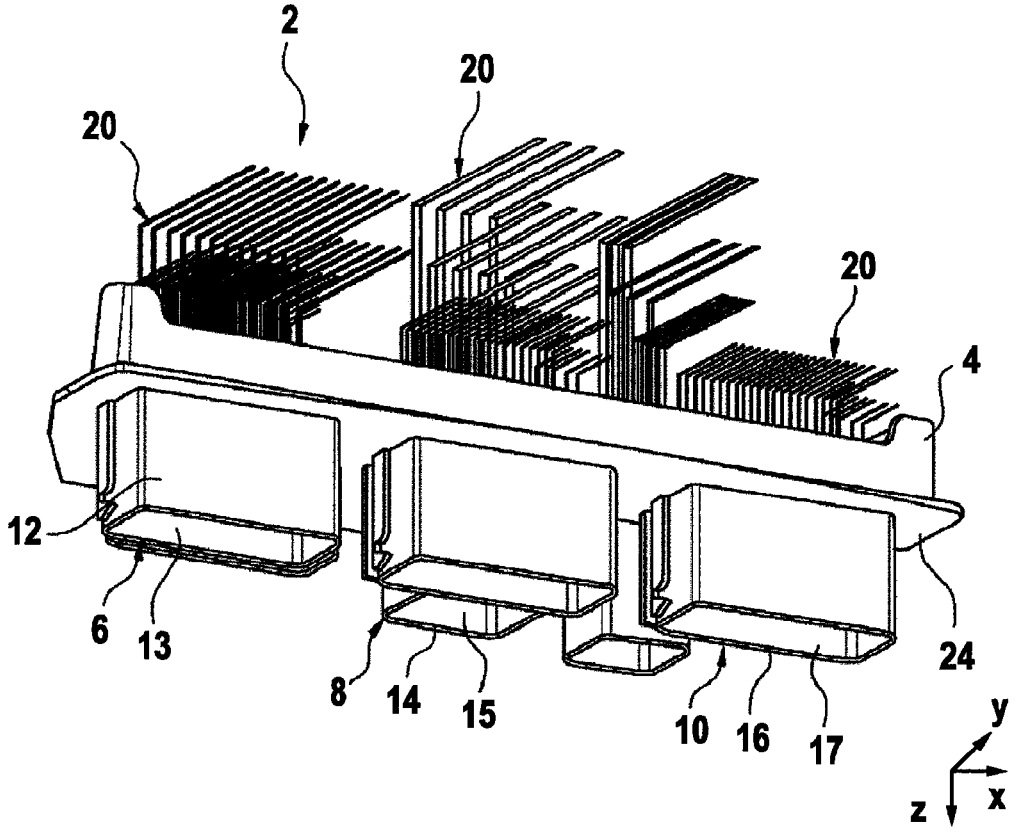
FIG. 1 shows a perspective view of a modular electrical connector assembly.

FIG. 1 shows a perspective view of a modular electrical connector assembly 2 that has a module carrier 4 and a plurality of connector modules 6, 8, 10. Connector modules 6, 8, 10 are disposed side-by-side on module carrier 4 in a longitudinal direction x and/or in a transverse direction y. Each of connector modules 6, 8, 10 has a connector housing collar 12, 14, 16 that projects in a direction z away from module carrier 4 and in each case surrounds an inner area 13, 15, 17, which is formed to receive a corresponding complementary electrical connector. Within each inner area 13, 15, 17, contact elements (cannot be seen in FIG. 1), e.g., in the form of pins, are disposed that are able to cooperate with complementary mating contact elements of the connector, and in this way, are able to produce an electrical connection between the contact elements and the mating contact elements. In this context, each of the contact elements may be connected to an electric line 20 which at its other end is connected, for example, to a circuit provided on a board (not shown).

Figure 2:
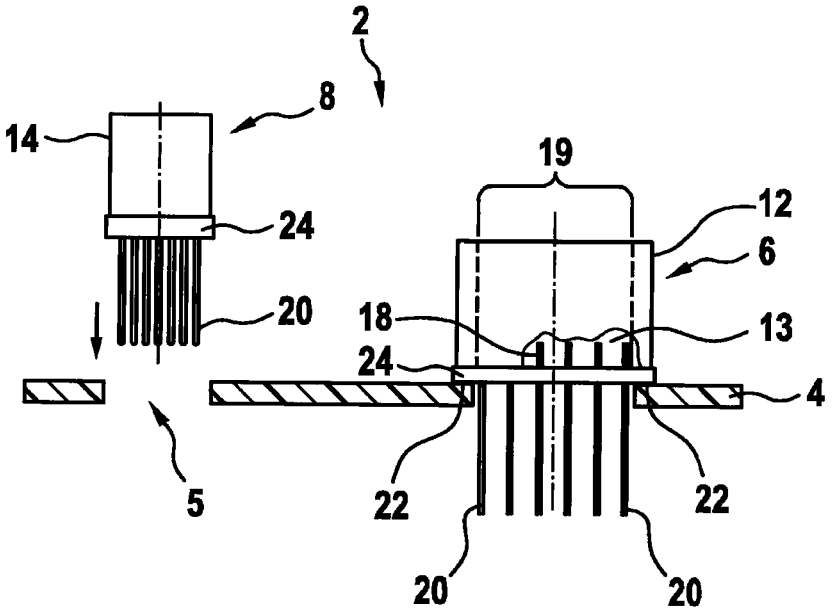
FIG. 2 shows a partially cut-away cross-sectional view of a modular electrical connector assembly produced according to the present invention.
Figure 3:
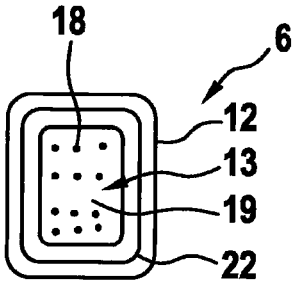
FIG. 3 shows a highly schematized top view of a connector module for a modular electrical connector assembly produced according to the present invention.

FIG. 2 shows a cross-sectional view of module carrier 4 having two connector modules 6, 8. A first connector module 6 is shown in a state in which it is mounted on module carrier 4. A second connector module 8 is shown in a state before it is fitted in the arrow direction into an opening 5 in module carrier 4 and then pressed against module carrier 4 and secured to it. FIG. 3 shows a highly schematized top view of connector module 6. Connector housing collar 12 surrounds an inner area 13 of connector module 6. In a partial area of this inner area 13, pin-shaped contact elements 18 are disposed, which project outwardly from the plane of module carrier 4. This partial area is referred to as contact area 19. Contact elements 18 extend through a base plate 24 of connector module 6. Base plate 24 and connector housing collar 12 projecting outward from this base plate 24 may be produced as a one-piece injection-molded component.

In order to mount connector module 6 on module carrier 4, it is attached to module carrier 4 in an attachment region 22. On one hand, attachment region 22 is preferably located laterally within connector housing collar 12, and on the other hand, however, outside of contact area 19, as can be seen well in the top view in FIG. 3. Attachment region 22 may enclose contact area 19 in ringlike fashion. As described in greater detail below, base plate 24 of connector module 6 may be joined with material locking to module carrier 4 in attachment region 22 by laser welding.

Figure 4:
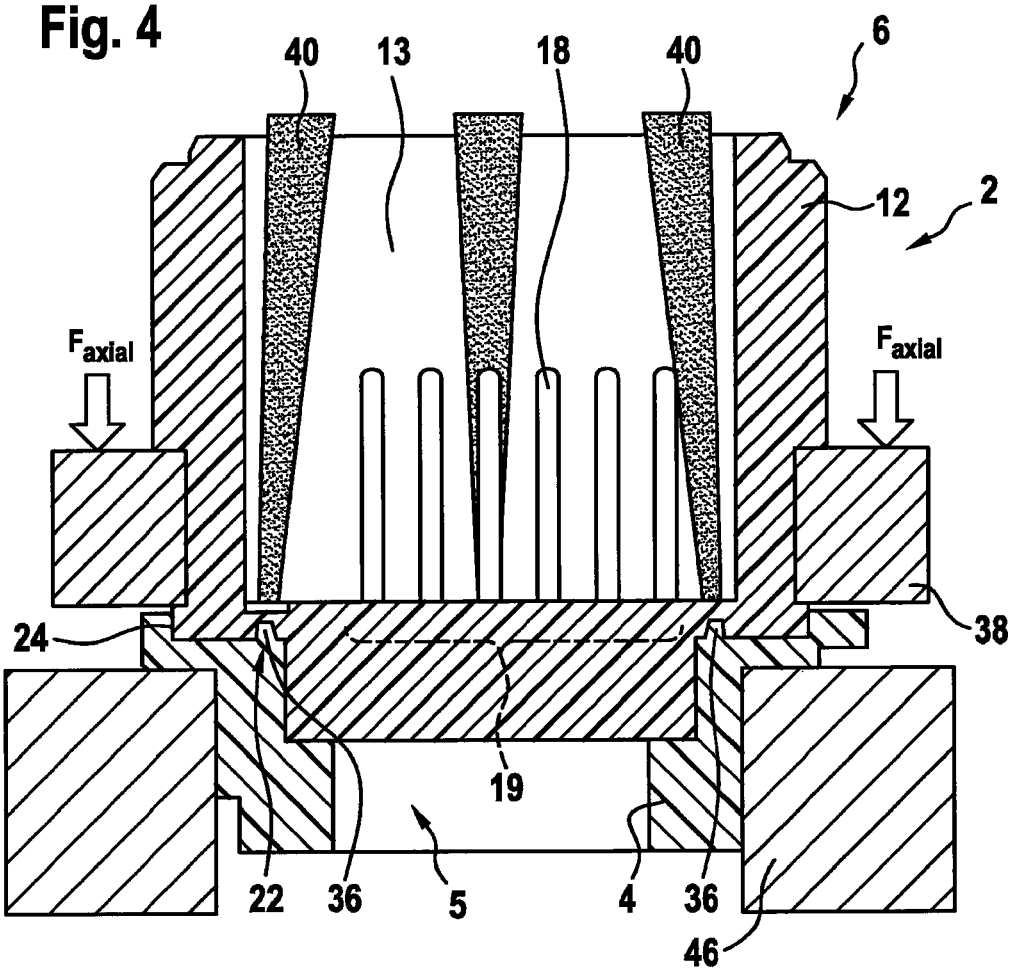
FIG. 4 shows a cross-section through a connector assembly produced according to the present invention to illustrate one manufacturing possibility.

FIG. 4 shows a cross-section through components of a connector assembly as well as through a device, with whose aid, these components may be joined to each other using laser-welding technologies. A module carrier 4 is accommodated in a well-fitting opening of a holding device 46, and is supported by it from below at its edges. A connector module 6 is inserted at its bottom side into complementarily formed opening 5 within module carrier 4, and is positioned precisely in relation to module carrier 4. With the aid of a hold-down device 38, connector module 6 is subsequently pressed with a force $F_{axial}$ downward toward module carrier 4. In this exactly positioned and pressed-together state, areas at a boundary surface between module carrier 4 and connector module 6 are locally fused with the aid of a laser beam 40. Connector module 6 is bound with material locking to module carrier 4 by this laser-welding process.

In order that laser beam 40, which is emitted from above in inner area 13 of connector module 6 surrounded by connector housing collar 12, be absorbed predominantly at the boundary surface between module carrier 4 and connector module 6 and lead there to a local melting of material, connector module 6 has a different plastic material than module carrier 4, and the properties of laser beam 40 are selected in such a way that the material of connector module 6 scarcely absorbs the laser beam, but the material of module carrier 4 is highly absorbent of the laser beam. For example, connector module 6 may be made of transparent polyamide and module carrier 4 may be made of polyamide that is mixed with carbon black particles, and is therefore optically absorbent. For instance, laser beam 40 may have a wavelength of 980 nm, at which the polyamide of connector module 6 is largely transparent, but the polyamide of module carrier 4 is highly absorbent.

In principle, it is also conceivable to radiate laser beam 40 not, as shown in FIG. 4, through bottom 24 of connector module 6 toward module carrier 4, but rather in the opposite direction through a material of module carrier 4—to be selected to be transparent in this case—toward a connector module 6, which then should be formed with a material that absorbs laser beam 40.

In order to back up the laser-welding process and to make the material-locking joint attained even more stable, it may be advantageous to provide a segment 36 on one of the components to be joined, e.g., on module carrier 4, in attachment region 22 to be joined. This segment 36 projects upward from module carrier 4 toward connector module 6. When connector module 6 is pressed by hold-down device 38 toward module carrier 4, bottom 24 of connector module 6 rests mainly on this segment 36. During the subsequent laser-welding process, parts of segment 36 and of bottom 24 pressed against it are melted and continue to be pressed together by hold-down device 38 during the ensuing solidification. In this manner, a very reliable material-locking bond may be formed between module carrier 4 and connector module 6 in the area of segment 36 provided in attachment region 22. For example, since segment 36 may be formed going around opening 5 in module carrier 4 in ringlike fashion, in this manner, a fluid-tight connection may also be produced between the two components 4, 6.

Figure 5:
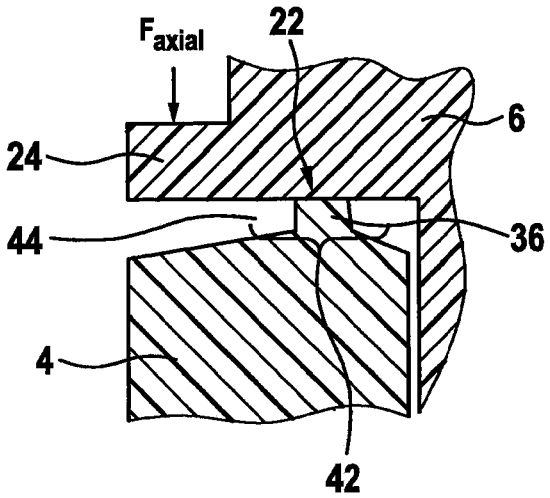
FIG. 5 shows a cross-section of a detail of an attachment region of a connector assembly produced according to the present invention.

As shown in FIG. 5, laterally next to segment 36 between module carrier 4 and connector module 6, free spaces 42 may be provided, into which material removed during the laser-welding process is able to flow. Moreover, next to segment 36, an outwardly opening gap 44 may be provided, whose cross-section increases with increasing lateral distance from segment 36. Such a gap 44, opening increasingly toward the outside, is able to prevent inevitably penetrated moisture from being able upon freezing, for example, to generate a force between module carrier 4 and connector module 6 which could jeopardize the integrity of the welded connection between these two components.

As shown in FIG. 4, laser beam 40 used for the laser welding may be directed from above, laterally within connector housing collar 12 onto attachment region 22. In the case of such a radiation direction from above, laser beam 40 is able to reach entire attachment region 22 that goes around opening 5 in ringlike fashion, without module carrier 4 and connector module 6 having to be moved. Instead, like in the case of a laser scanner, for example, laser beam 40 may be shifted gradually along the attachment region using suitable mirror optics. There is therefore no risk that connector module 6 will shift relative to module carrier 4 during the laser-welding operation and that the exact positioning adjusted beforehand will thereby get lost.

In this context, laser beam 40 may be dimensioned and directed in such a way that, for example, it is radiated essentially parallel to the inner surfaces of connector housing collar 12, and therefore in the ideal case, no shadowing of laser beam 40 occurs owing to overlaps of its beam path with connector housing collar 12 and/or contact elements 18 provided in contact area 19.

In order to rule out the risk of shadowing, especially by contact elements 18, as an alternative, connector module 6 may be laser-welded to module carrier 4 before contact elements 18 are introduced at bottom 24 of connector module 6.

What is claimed is:

1. A method for producing a modular electrical connector assembly for a control unit in a motor vehicle, the method comprising:

providing a module carrier; and providing at least a first connector module and a second connector module placing one of the respective connector modules in an opening in the module carrier;

precisely positioning the connector module relative to the module carrier, pressing the connector module against the module carrier; and laser welding the connector module to the module carrier in an attachment region;

wherein the connector assembly includes the module carrier, in which the first connector module and the second connector module are disposed side-by-side on the module carrier, wherein both the first connector module and the second connector module each have a connector housing collar which projects in a direction away from the module carrier and is formed to receive an electrical connector, wherein the first connector module and the second connector module each have a plurality of contact elements disposed in a contact area within the respective connector housing collar and formed to cooperate with complementary mating contact elements of the respective electrical connector, wherein the module carrier and the connector modules are made of different materials, and wherein a laser is used for the laser welding, and wherein a laser beam of the laser is absorbed considerably less in a material of a component selected from one of the module carrier and the connector modules than in a material of a component selected from another one of the module carrier and the connector modules.

2. The method as recited in claim 1, wherein the laser beam is directed in the attachment region through the more weakly absorbent component onto the more strongly absorbent component.

3. The method as recited in claim 1, wherein in the attachment region, at least one of the module carrier and the connector modules has a segment projecting from one of the module carrier and the respective connector module toward one of the respective connector module and the module carrier, and wherein laterally next to the segment, a free space remains into which material removed during the laser-welding process is able to flow.

4. The method as recited in claim 3, wherein the attachment region is situated between the connector housing collar and the contact area.

5. The method as recited in claim 4, wherein a laser beam used in the laser-welding process is directed laterally within the connector housing collar onto the attachment region.

6. The method as recited in claim 5, wherein the module carrier is retained in a holding device during the laser-welding process, and wherein the connector module is pressed against the module carrier by a displaceable hold-down device.

7. The method as recited in claim 6, wherein the contact elements are not inserted into the connector module until after the laser-welding process.

8. The method as recited in claim 6, wherein the contact elements are not inserted into the connector module until after the laser-welding process.

9. The method as recited in claim 3, wherein the module carrier is retained in a holding device during the laser-welding process, and wherein the connector module is pressed against the module carrier by a displaceable hold-down device.

10. The method as recited in claim 1, wherein the attachment region is situated between the connector housing collar and the contact area.

11. The method as recited in claim 1, wherein a laser beam used in the laser-welding process is directed laterally within the connector housing collar onto the attachment region.

12. The method as recited in claim 1, wherein the module carrier is retained in a holding device during the laser-welding process, and wherein the connector module is pressed against the module carrier by a displaceable hold-down device.

13. The method as recited in claim 1, wherein the contact elements are not inserted into the connector module until after the laser-welding process.

* * * * *